US005230153A

United States Patent [19]

Andis

[11] Patent Number: 5,230,153

[45] Date of Patent: Jul. 27, 1993

[54] MOUNTING BRACKET FOR HAIR TRIMMERS

[75] Inventor: Matthew L. Andis, Racine, Wis.

[73] Assignee: Andis Company, Racine, Wis.

[21] Appl. No.: 817,746

[22] Filed: Jan. 7, 1992

Related U.S. Application Data

[63] Continuation-in-part of Ser. No. 595,545, Oct. 11, 1990, Pat. No. 5,092,048.

[51] Int. Cl.[5] ..... B26B 19/02; B26B 19/12

[52] U.S. Cl. ..... 30/216; 30/221

[58] Field of Search ..... 30/196, 208, 210, 216, 30/221

[56] References Cited

U.S. PATENT DOCUMENTS 1,956,042 4/1934 Oster ..... 30/221
2,928,171 3/1960 Oster ..... 30/221
3,992,778 11/1976 Urbush ..... 30/216
4,081,905 4/1978 Urbush ..... 30/221

*Primary Examiner*—Frank T. Yost
*Assistant Examiner*—Paul M. Heyrana, Sr.
*Attorney, Agent, or Firm*—Michael, Best & Friedrich

[57] ABSTRACT

A hair trimmer comprising a body, a cutting assembly including a reciprocable cutter, drive structure supported by the body for reciprocating the cutter and including a drive member being reciprocable along an axis, hinge structure supported by the body for pivotably supporting the cutting assembly for movement between a first position wherein the drive member operably engages the cutter and a second position spaced from the first position, and structure for restricting movement of the drive member in a direction away from the axis when the cutting assembly moves to the first position from the second position.

19 Claims, 3 Drawing Sheets

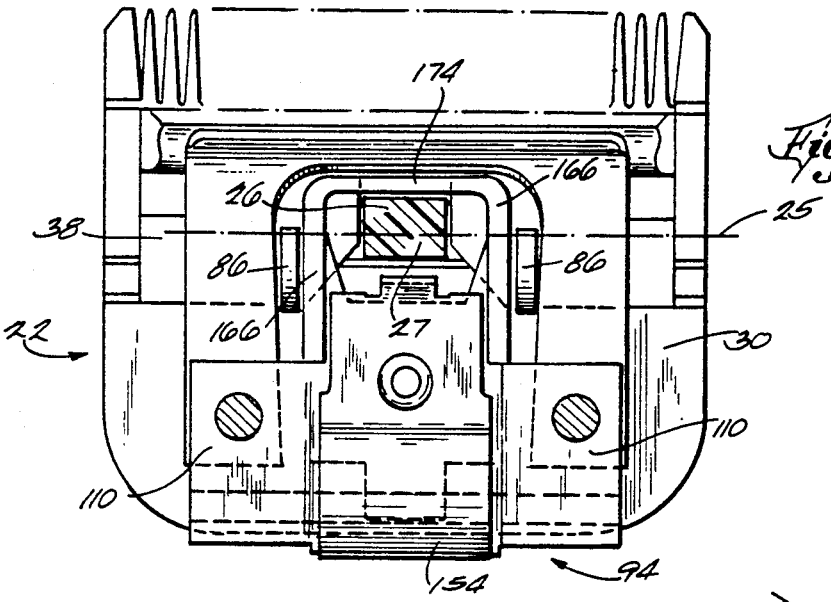
Fig. 2.
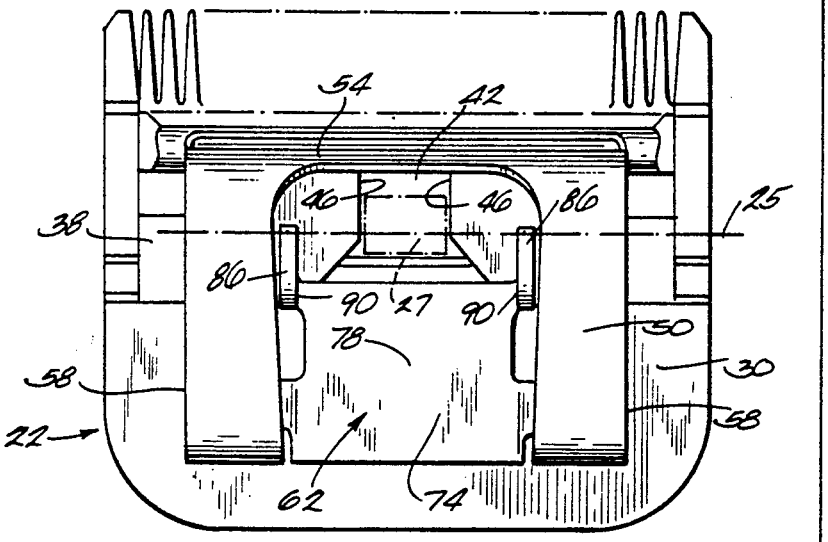
Fig. 3
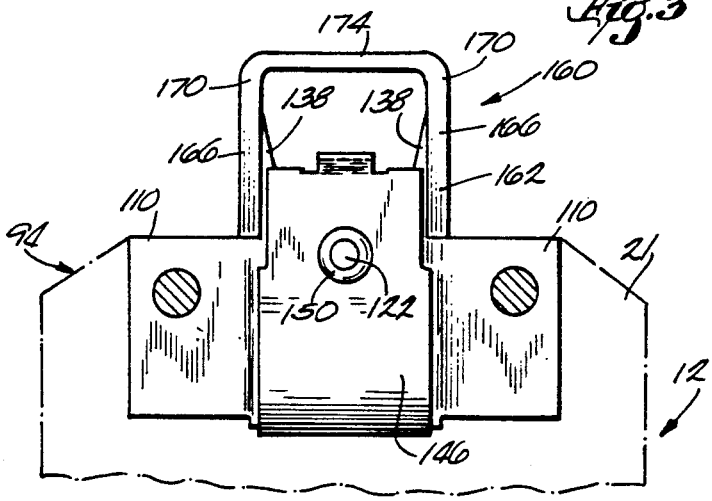

MOUNTING BRACKET FOR HAIR TRIMMERS

BACKGROUND OF THE INVENTION

Related Applications

This application is a continuation-in-part of pending U.S. patent application Ser. No. 595,545 filed Oct. 11, 1990, U.S. Pat. No. 5,092,048 issued Mar. 3, 1992.

TECHNICAL FIELD

The invention relates to electric hair trimmers, and more particularly to mounting brackets for supporting cutting head assemblies for use with electric hair trimmers.

RELATED PRIOR ART

It is generally known to provide an electric hair trimmer with a cutting head assembly which can be releasably and operably mounted on the trimmer. The provision of a releasable cutting head assembly facilitates the cleaning and replacement of the cutting head assembly. Typically, an electric hair trimmer for use with a releasable cutting head assembly includes a body and a spring-loaded, pivotable support tongue which is fixed to one end of the clipper body. The support tongue is engageable with the associated cutting head assembly to hold the cutting head assembly in an operable position on the clipper body. When the tongue is pivoted forwardly to an "open" position away from the body, the cutting head assembly can be placed on the tongue. When the tongue is snapped into a "closed" position against the clipper body, the cutting head assembly is held securely against the clipper body.

Two examples of releasable cutting head assemblies for use in association with a hair trimmer are illustrated respectively in U.S. Pat. No. 2,182,597 which issued to Oster on Dec. 5, 1939, and in U.S. Pat. No. 2,928,171 which issued to Oster on Mar. 15, 1960. The above-listed U.S. Patents illustrate cutting head assemblies which include a tongue-receiving socket for mounting the assembly on an associated support tongue.

SUMMARY OF THE INVENTION

The invention provides a hair trimmer comprising a body, a cutting assembly including a reciprocable cutter, drive means supported by the body for reciprocating the cutter and including a drive member being reciprocable along an axis, hinge means supported by the body for pivotably supporting the cutting assembly for movement between a first position wherein the drive member operably engages the cutter and a second position spaced from the first position, and means for restricting movement of the drive member in a direction away from the axis when the cutting assembly moves to the first position from the second position.

One embodiment of the invention provides a hair trimmer comprising a body, a cutting assembly including a reciprocable cutter and a wall having a pair of spaced-apart surfaces, drive means supported by the body for reciprocating the cutter, and hinge means supported by the body for supporting the cutting assembly, the hinge means including a tongue supporting the cutting assembly and being pivotable between a first position wherein the drive means operably engages the cutter and a second position spaced from the first position and including a pair of members respectively engageable with the spaced-apart surfaces when the tongue is in the first position, and means for preventing relative movement of the pair of members when the tongue moves to the first position from the second position.

One embodiment of the invention provides a hair trimmer comprising a body a cutting assembly including a reciprocable cutter, drive means supported by the body for reciprocating the cutter and including a drive member having a portion extending from the body, and hinge means supported by the body for pivotably supporting the cutting assembly for movement between a first position wherein the drive member operably engages the cutter and a second position spaced from the first position, the hinge means including a retainer portion surrounding the drive member portion when the cutting assembly is in the first position.

One embodiment of the invention provides a hair trimmer comprising a body, a cutting assembly including a reciprocable cutter defining a drive socket, drive means supported by the body for reciprocating the cutter and including a drive member moveable along an axis and engageable with the socket, hinge means supported by the body for pivotably supporting the cutting assembly for movement between a first position wherein the drive member is operably engageable with the cutter when the drive member and the drive socket are aligned and a second position spaced from the first position, and means for restricting movement of the drive member in a direction away from the axis when the cutting assembly moves toward the first position from the second position and when the drive socket and the drive member are not aligned.

Other features and advantages of the invention will become apparent to those of ordinary skill in the art upon review of the following detailed description, claims, and drawings.

BRIEF DESCRIPTION OF THE DRAWINGS

FIG. 2 is a plan view of a mounting bracket supporting a cutting head assembly.

FIG. 3 is an exploded view of the mounting bracket and cutting head assembly illustrated in FIG. 2.

Figure 7:
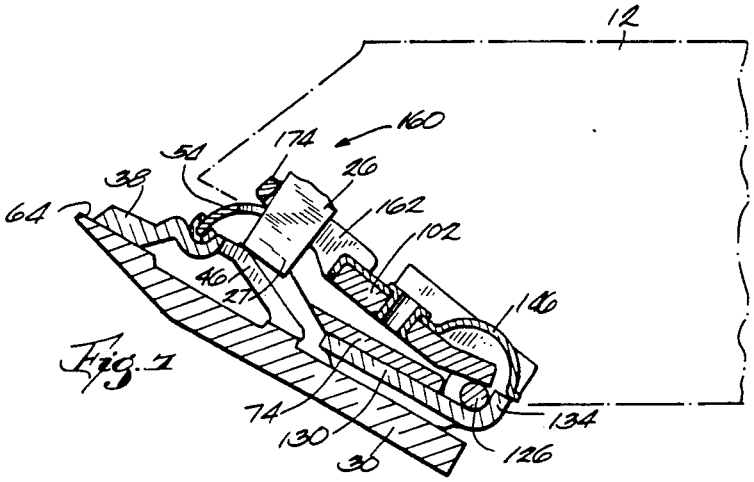
FIG. 7 is a cross-sectional view of a mounting bracket and misaligned cutting head assembly.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE OF THE PREFERRED EMBODIMENT

Figure 1:
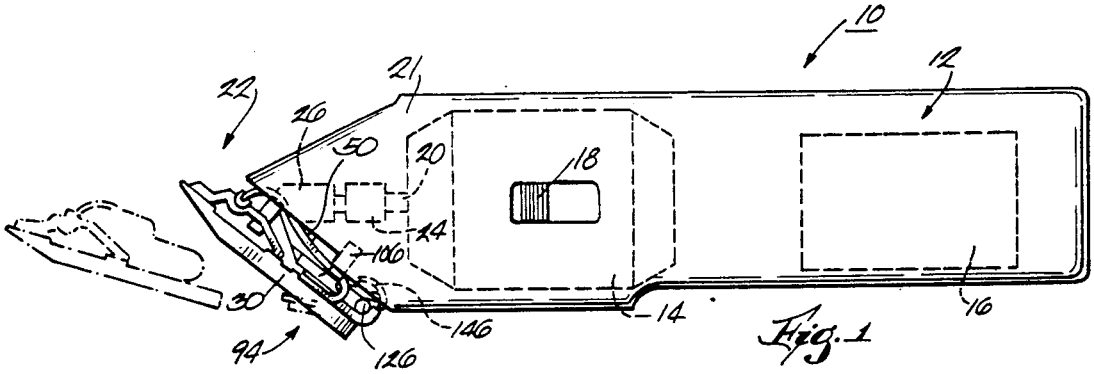
FIG. 1 is an elevation side view of an electric hair trimmer embodying various features of the invention.

Illustrated in FIG. 1 is an electric hair trimmer 10 having a casing or body 12 which is formed to be easily hand-held. The body 12 houses an electric motor 14 which is connected to a suitable source of current 16 which, as shown schematically in FIG. 1, can be in the form of a battery. However, the trimmer body could also support an electric cord for connection with a suitable source of current. A user operable switch 18 for turning the electric motor 14 "on" and "off" extends from the clipper body 12. A rotatable drive shaft 20 extends from the electric motor 14 to an end 21 of the clipper body 12 which supports a cutting head assembly 22. The drive shaft 20 supports an eccentrically mounted cam 24 which, when rotated, imparts a reciprocating motion along (FIG. 2) a laterally extending axis 25 to a drive lever or member 26 which (FIG. 7) has a distal end 27 that extends from the clipper body 12 and that engages the cutting head assembly 22 in a manner discussed below. The trimmer 10 thus provides drive means supported by the body 12 for reciprocating a cutter.

The cutting head assembly 22 includes (FIGS. 3 and 5) a bottom plate 30 having an upper surface 34. The upper surface 34 of the bottom plate 30 supports a top plate or cutter 38 for reciprocal sliding movement relative thereto along the laterally extending axis 25. The cutter 38 includes (FIG. 3) a rearwardly opening channel or drive socket 42 which defines a pair of opposed drive surfaces 46 which are spaced apart the approximate width of the distal end 27 of the drive member 26 and which are engageable therewith. The cutter 38 is reciprocally driven by the drive member 26 relative to the bottom plate 30 in a conventional manner by the reciprocation of the drive member 26 and the operable engagement of the drive surfaces 46 and the distal end 27 of the drive member 26.

The cutting head assembly 22 also includes a leaf spring 50 for biasing the cutter 38 against the upper surface 34 of the bottom plate 30 to maintain sufficient pressure therebetween for effective cutting. The leaf spring 50 includes (FIG. 5) a bight portion 54 positioned on the cutter 38 and two legs 58 extending rearwardly from the bight portion 54 to form therebetween a U-shaped space 62. Each leg 58 includes (FIG. 5) a curled portion 66 which extends under the leg 58 and terminates in an end 70 which is fixed to the upper surface 34 of the bottom plate 30. The cutting head assembly 22 also includes (FIGS. 3 and 5) a strap 74 extending between the leg ends 70, having a central portion 78 spaced from the upper surface 34 of the lower plate 30, and defining a socket 82. A pair of alignment flanges 86 extend upwardly from the central portion 78 of the strap 74 and provide respective opposed facing contact surfaces 90.

Figure 4:
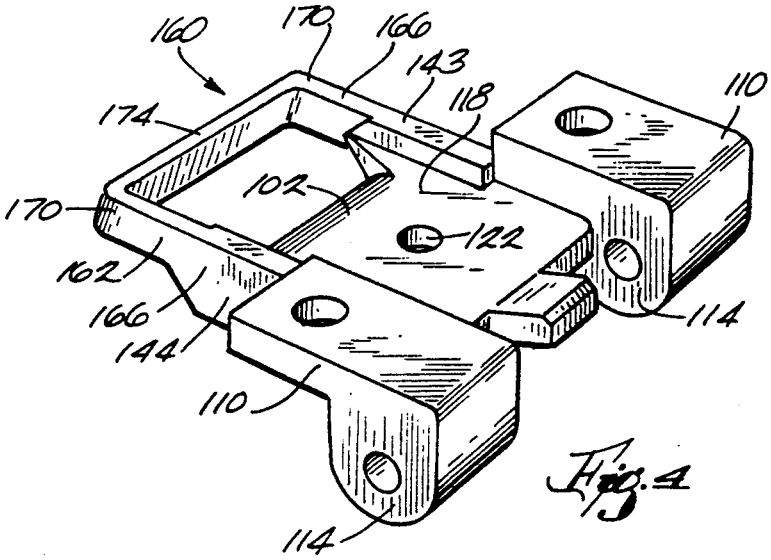
FIG. 4 is a perspective view of a portion of the mounting bracket illustrate in FIG. 2.

The hair trimmer 10 also includes (FIGS. 2–5) a mounting bracket 94 that is fixed to the end 21 of the clipper body 12. The mounting bracket 94 provides mounting means or hinge means 98 for releasably engaging the cutting head assembly 22 and for pivotably supporting the cutting head assembly 22 so that the cutting head assembly can be operably supported on the trimmer 10 and alternatively disengaged and removed from the trimmer 10. While various features of the hinge means 98 are described herein, U.S. Pat. No. 2,182,597, which issued to Oster on Dec. 5, 1939, also describes means for readily removably attaching a cutting head assembly to a clipper body and for holding the cutting head assembly in place thereon. While other constructions can be employed, in the illustrated embodiment (FIGS. 4 and 5), the hinge means 98 includes a base plate 102 which is fixed to the end 21 of the clipper body 12 by a pair of screws (only one shown in FIG. 1). The base plate 102 carries (FIG. 4) a pair of laterally spaced arms 110 which are curled to form a pair of hinge loops 114. A central portion 118 of the base plate 102 extends along the end 21 of the clipper body 12 and, for reasons explained below, has therethrough a fastener hole 122.

Figure 6:
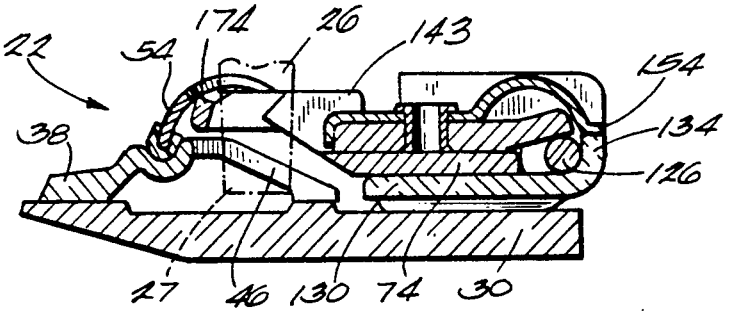
FIG. 6 is a cross-sectional view of the mounting bracket and cutting head assembly shown in FIG. 2.
Figure 5:
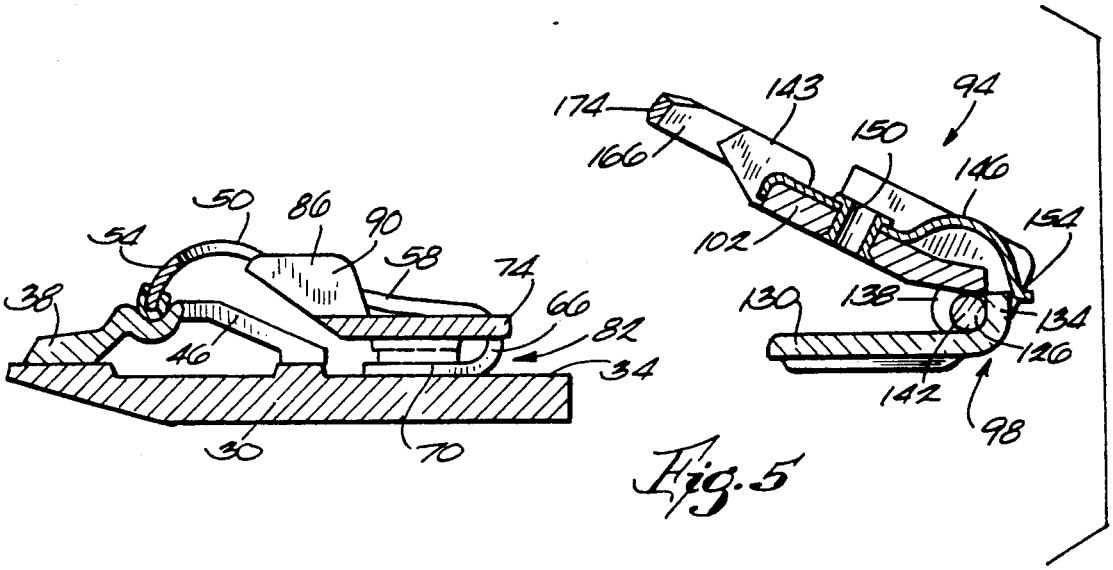
FIG. 5 is a cross-sectional view of the mounting bracket and cutting head assembly shown in FIG. 3.

As shown in FIGS. 5 and 6, a hinge pin 126 extends through the hinge loops 114 and hingedly connects a support tongue 130 to the base plate 102. The support tongue 130 is generally planar and includes a bent end or tab 134 and a pair of flanges 138 extending therefrom adjacent the tab 134. The flanges 138 have respective pin holes 142 therethrough aligned with the hinge loops 114. The hinge loops 114 and the pin holes 142 house the hinge pin 126 so that the base plate 102 and the support tongue 130 are pivotally connected so that the support tongue 130 is moveable relative to the base plate 102 between "open" and "closed" positions and so that the mounting bracket 94 is moveable between a corresponding first "closed" position wherein the support tongue 130 is held next to the base plate 102 and a corresponding second "open" position spaced from the closed position wherein the tongue 130 is spaced from the base plate 102 and extends away from the end 21 of the clipper body 12.

The base plate 102 also includes (FIG. 4) a pair of side flanges 143 which extend upwardly from the central portion 38 to either side of the drive lever 26 and which provide spaced apart alignment surfaces 144. The alignment surfaces 144 nest with respective contact surfaces 90 of the alignment flanges 86 on the cutting assembly 22 to align and position the cutting assembly 22 relative to the drive member 26 when the cutting assembly 22 is supported on the mounting bracket 94 and when the mounting bracket is in its closed position.

The hinge means 98 also provides (FIG. 5) a leaf spring 146 which overlies the central portion of the base plate 102 and which is fixed thereto by a suitable fastener 150 extending through the fastener hole 122. The spring 146 has a detent portion 154 which is engageable with the support tongue tab 134 for holding the tongue 130 in either the "open" or "closed" position. When the mounting bracket 23 is moved to its open position, the tab 134 rotates (counter-clockwise in FIG. 5) relative to the detent 154 and is held in position by engagement between the detent 154 and the rearward side of the tab 134. When the mounting bracket 23 is moved toward its closed position, the tab 134 rotates (clockwise in FIG. 4) relative to the detent 154 so that the detent 154 engages the end of the tab 134

When the mounting bracket 94 is in its open position, the cutting head assembly 23 can be placed on the support tongue 130 by sliding the socket 82 over the support tongue 130. The support tongue 130 and the cutting head assembly 22 supported thereon can then (FIG. 6) be pivoted away from the open position toward the closed position. When the cutting head assembly 22 is so pivoted relative to the base plate 102 and the trimmer body 12, the tab 134 of the support tongue 130 slides out of engagement with the detent portion 154 of the leaf spring 146 and the force of the leaf spring 146 on the support tongue 130 clamps the socket-defining strap 74 between the support tongue 130 and the base plate 102. Also, due to the force of the leaf spring 146 and the rotatable relationship of the detent 154 and tab 134, the pivotal movement of the mounting bracket 94 from its open position to its closed position is precipitous so that the cutting head assembly 22 supported on the tongue 130 tends to snap into engagement with the base plate 102.

Preferably, when the cutting head assembly 22 is pivoted into engagement with the base plate 102, the drive socket 42 in the cutter 38 and the drive member 26 are aligned so that the distal end 27 of the drive member 26 moves into engagement with the drive socket 42 and is located between the drive surfaces 78. When the drive member 26 and the cutter are so engaged, the trimmer 10 can be operated so that the reciprocation of the drive member 26 along the axis 25 reciprocates the cutter along the axis 25 relative to the bottom plate 30.

If the cutting head assembly 22 is placed on the support tongue 130 of the mounting bracket 94 when the mounting bracket 94 is in its open position and then (FIGS. 7 and 8) pivoted toward its closed position when the drive socket 42 and the drive member 26 are not aligned, however, the drive member 26 may not move into operable engagement with the drive surfaces 46 but may contact the upper surface of the cutter 38. This interference between the drive member 26 and the cutting head assembly 22 as the mounting bracket 94 and the cutting head assembly 22 move toward their closed positions can possibly damage the drive member 26 as well as other driving components of the trimmer 10 which support and reciprocate the drive member 26 by causing excessive deflection of the drive member 26 away from its axis of travel 25. The snapping action of the mounting bracket 94 between its open and closed positions can increase the damage which may be caused by the misalignment of the drive member 26 and the drive socket 42.

Figure 8:
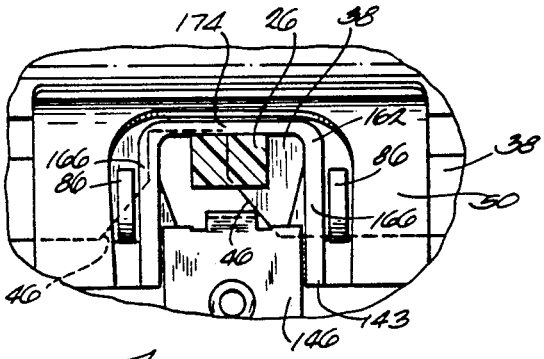
FIG. 8 is a plan view of the mounting bracket and cutting head assembly shown in FIG. 7.

In order to prevent or mitigate the damage which may be caused by interference between the drive socket 42 and the drive member 26 caused by misalignment or other causes, the trimmer 10 also includes (FIGS. 4, 7 and 8) means 160 for restricting movement of the drive member 26 away from the axis 25 when the cutting assembly 22 is supported by the mounting bracket 94 and the mounting bracket 94 moves toward its closed position from its open position. While various other arrangements can be successfully employed, in the preferred embodiment, the means 160 for restricting movement of the drive member 26 away from the axis 25 includes a retainer portion 162 on the mounting bracket 94 which surrounds the distal end 27 of the drive member 26 and is in closely spaced relation thereto. The retainer portion 162 includes a pair of support members 166 which extend from respective side flanges 143 on the base plate 102 and which extend on opposite sides of the drive member 26. The support members 166 are spaced apart by a predetermined dimension so that the support members 166 do not interfere with the ordinary range of movement of the drive member 26 along the axis 25 during normal trimmer operation. Each support member 166 has an end 170 extending past the distal end 27 of the drive member 26. The retainer portion 162 also includes a bridge 174 extending generally parallel to the axis 25 between the support member ends 170 so that the distance between the support members 166 is maintained and so that the retainer portion 162 encircles or surrounds the distal end 27 of the drive member 26 when the mounting bracket 94 is in either its open or closed position. As shown in FIG. 7, however, the retainer portion 162 is located such that the distal end 27 of the drive member 26 extends past the support members 166 and the bridge 174 so that the drive member 26 can extend into the drive socket 42 and engage the drive surfaces 46 of the cutter 38.

Preferably, the bridge 174 is relative closely spaced to the drive member 26 so that (FIG. 8), in the event of interference between the drive socket 42 and the drive member 26 as the mounting bracket 94 moves from their open position toward its closed position and the cutting assembly 22 is moved into engagement with the drive member 26, the drive member 26 is restricted in the distance it can move away from its axis of travel 25 by engagement with the bridge portion 174 of the retainer 162. By limiting this possible deflection of the drive member 26, possible damage to the drive member 26 and to related components of the trimmer 10 can be mitigated or prevented.

While not illustrated, one of ordinary skill in the art will readily understand that alternative embodiments of the means 160 for restricting movement of the drive member 26 away from its axis of travel 25 are available. For example, a retainer portion similar to retainer portion 162 could be supported by any of the body 12, electric motor 14 or may other portion of the trimmer 10 that is relatively unmovable laterally of axis 25 during movement of the mounting brackets 94 from its open position to its closed position.

Various features of the invention are set forth in the following claims.

I claim:

1. A hair trimmer comprising a body, a cutting assembly including a reciprocable cutter, drive means supported by said body for reciprocating said cutter and including a drive member being reciprocable along an axis, hinge means supported by said body for pivotably supporting said cutting assembly for movement between a first position wherein said drive member operably engages said cutter and a second position spaced from said first position, said hinge means including means for removably supporting said cutting assembly, and means for restricting movement of said drive member in a direction away from said axis when said cutting assembly moves to said first position from said second position.

2. A hair trimmer comprising a body, a cutting assembly including a reciprocable cutter, drive means supported by said body for reciprocating said cutter and including a drive member being reciprocable along an axis, hinge means supported by said body for pivotably supporting said cutting assembly for movement between a first position wherein said drive member operably engages said cutter and a second position spaced from said first position, and means for restricting movement of said drive member in a direction away from said axis when said cutting assembly moves to said first position from said second position, said means for restricting movement of said drive member including a bridge extending generally parallel to said axis.

3. A hair trimmer as set forth in claim 2 wherein said means for restricting movement of said drive member includes at least one support member fixed to said body and wherein said at least one support member supports said bridge.

4. A hair trimmer as set forth in claim 3 wherein said at least one support member includes a pair of spaced apart support members and wherein said bridge extends between said support members.

5. A hair trimmer as set forth in claim 4 wherein said support members have respective ends and wherein said bridge extends between said ends.

6. A hair trimmer comprising a body, a cutting assembly including a reciprocable cutter, drive means supported by said body for reciprocating said cutter and including a drive member having wherein said drive member a portion extending from said body, hinge means supported by said body for pivotably supporting said cutting assembly for movement between a first position wherein said drive member operably engages said cutter and a second position spaced from said first position, and means for restricting movement of said drive member in a direction away from said axis when said cutting assembly moves to said first position from said second position, said means for restricting movement of said drive member including a retainer portion surrounding said portion of said drive member when said cutting assembly is in said first position.

7. A hair trimmer comprising a body, a cutting assembly including a reciprocable cutter and a wall having a pair of spaced-apart surfaces, drive means supported by said body for reciprocating the cutter, and hinge means supported by said body for supporting said cutting assembly, and including a tongue supporting said cutting assembly and being pivotable between a first position wherein said drive member operably engages said cutter and a second position spaced from said first position and including a pair of members respectively engageable with said spaced-apart surfaces when said tongue is in said first position, and means including a bridge extending between said members for preventing relative movement of said pair of members when said tongue moves to said first position from said second position.

8. A hair trimmer as set forth in claim 7 wherein said pair of members define therebetween a space having a predetermined dimension and wherein said means for preventing relative movement of said pair of members includes means for preventing change in said predetermined dimension.

9. A hair trimmer as set forth in claim 7 wherein said pair of members are spaced apart in a direction and wherein said means for preventing relative movement of said pair of members includes means for preventing relative movement of said members in said direction.

10. A hair trimmer as set forth in claim 7 wherein said base portion, said pair of members and said bridge define therebetween an enclosed space.

11. A hair trimmer as set forth in claim 10 wherein each of said members has an end extending away from said base portion and wherein said bridge extends between said respective ends.

12. A hair trimmer as set forth in claim 7 wherein said tongue is pivotable about an axis, and wherein said means for preventing relative movement of said pair of members includes means for preventing relative movement of said members in the direction of said axis.

13. A hair trimmer comprising a body, a cutting assembly including a reciprocable cutter, drive means supported by said body for reciprocating said cutter and including a drive member having a portion extending from said body, hinge means supported by said body for pivotably supporting said cutting assembly for movement between a first position wherein said drive member operably engages said cutter and a second position spaced from said first position, and a retainer fixed to said body and engageable with said drive member portion independently of said cutter assembly when said cutting assembly is in said first position.

14. A hair trimmer as set forth in claim 13 wherein said retainer portion is in closely spaced relation to said drive member portion.

15. A hair trimmer as set forth in claim 14 wherein said retainer portion includes a pair of spaced apart support members extending from said base plate on opposite sides of said drive member portion.

16. A hair trimmer as set forth in claim 15 wherein said retainer portion includes a bridge extending between said support members.

17. A hair trimmer comprising a body, a cutting assembly including a reciprocable cutter, drive means supported by said body for reciprocating said cutter and including a drive member having a portion extending from said body, hinge means supported by said body for pivotably supporting said cutting assembly for movement between a first position wherein said drive member operably engages said cutter and a second position spaced from said first position, said hinge means including means for removably supporting said cutting assembly, and a retainer fixed to said body and engageable with said drive member portion when said cutting assembly is in said first position.

18. A hair trimmer comprising a body, a cutting assembly including a cutter reciprocable along an axis, drive means supported by said body for reciprocating said cutter and including a drive member having a portion extending from said body, hinge means supported by said body for pivotably supporting said cutting assembly for movement between a first position wherein said drive member operably engages said cutter and a second position spaced from said first position, and a retainer fixed to said body and engageable with said drive member portion when said cutting assembly is in said first position, said retainer including a bridge extending generally parallel to said axis in closely spaced relation to said drive member portion.

19. A hair trimmer comprising a body, a cutting assembly including a reciprocable cutter defining a drive socket, drive means supported by said body for reciprocating said cutter and including a drive member moveable along an axis and engageable with said socket, hinge means supported by said body for pivotably supporting said cutting assembly for movement between a first position wherein said drive member operably is operable engageable with said cutter when said drive member and said drive socket are aligned and a second position spaced from said first position, and means independent of said cutter assembly and engageable with said drive means for restricting movement of said drive member in a direction away from said axis when said cutting assembly moves toward said first position from said second position and in the event of misalignment of said drive socket and said drive member.

* * * * *